US008725024B2

(12) United States Patent
Tashiro

(10) Patent No.: US 8,725,024 B2
(45) Date of Patent: May 13, 2014

(54) IMAGE FORMING APPARATUS WITH A FAN FOR COOLING A CONVEYANCE PATH FOR TWO-SIDED IMAGE FORMATION

(75) Inventor: Yoshiaki Tashiro, Osaka (JP)

(73) Assignee: Kyocera Mita Corporation (JP)

( * ) Notice: Subject to any disclaimer, the term of this patent is extended or adjusted under 35 U.S.C. 154(b) by 185 days.

(21) Appl. No.: 13/398,176

(22) Filed: Feb. 16, 2012

(65) Prior Publication Data

US 2012/0213564 A1 Aug. 23, 2012

(30) Foreign Application Priority Data

Feb. 17, 2011 (JP) ..... 2011-031739

(51) Int. Cl.
*G03G 21/20* (2006.01)

(52) U.S. Cl.
USPC ..... 399/92; 399/364

(58) Field of Classification Search
USPC ..... 399/364, 92
See application file for complete search history.

(56) References Cited

U.S. PATENT DOCUMENTS

| | | | | |
|---|---|---|---|---|
| 5,095,371 | A * | 3/1992 | Tanaka et al. | 358/300 |
| 5,839,032 | A * | 11/1998 | Yasui et al. | 399/124 |
| 6,134,404 | A * | 10/2000 | Iwai et al. | 399/110 |
| 6,564,019 | B2 * | 5/2003 | Ahn et al. | 399/13 |
| 6,954,602 | B2 * | 10/2005 | Kimizuka | 399/92 |
| 7,937,014 | B2 * | 5/2011 | Kawamata | 399/92 |
| 8,095,040 | B2 * | 1/2012 | Tomita et al. | 399/121 |
| 2002/0098010 | A1 | 7/2002 | Inoue et al. | |
| 2002/0102110 | A1 * | 8/2002 | Kida | 399/124 |
| 2003/0210924 | A1 | 11/2003 | Inoue et al. | |
| 2004/0091281 | A1 * | 5/2004 | Kimizuka | 399/92 |
| 2006/0269321 | A1 * | 11/2006 | Kang | 399/124 |
| 2007/0104509 | A1 * | 5/2007 | Kabashima | 399/124 |
| 2007/0189798 | A1 | 8/2007 | Matsuno | |
| 2007/0269234 | A1 * | 11/2007 | Kurita et al. | 399/111 |
| 2008/0240769 | A1 * | 10/2008 | Kawasaki et al. | 399/92 |
| 2009/0028587 | A1 * | 1/2009 | Hanashi et al. | 399/27 |
| 2009/0123175 | A1 * | 5/2009 | Takemoto | 399/107 |
| 2010/0054791 | A1 * | 3/2010 | Shimizu | 399/92 |
| 2011/0064449 | A1 * | 3/2011 | Shimizu | 399/92 |
| 2012/0321339 | A1 * | 12/2012 | Tsuru et al. | 399/92 |

FOREIGN PATENT DOCUMENTS

| | | |
|---|---|---|
| JP | 8-16011 | 1/1996 |
| JP | 9-328249 | 12/1997 |
| JP | 11-95496 | 4/1999 |
| JP | 11-194567 | 7/1999 |

(Continued)

*Primary Examiner* — G. M. Hyder
(74) *Attorney, Agent, or Firm* — Gerald E. Hespos; Michael J. Porco; Matthew T. Hespos

(57) ABSTRACT

An image forming apparatus includes a fixing unit arranged in an apparatus main body and adapted to perform a fixing process to fix an image to a recording sheet by heat, first conveyance path for conveying the recording sheet via an image forming unit and the fixing unit, second conveyance path for conveying the recording sheet having the fixing process performed thereon to an upstream side of the image forming unit in the case of performing the image forming process on both sides of the recording sheet, a first cover openably and closably attached to the apparatus main body, a second cover for covering the second conveyance path, the second cover being openably and closably attached to the apparatus main body and openable and closable when the first cover is in an open state, and fans provided on the second cover for supplying air streams to the second conveyance path.

9 Claims, 9 Drawing Sheets

(56) References Cited

FOREIGN PATENT DOCUMENTS

| | | |
|---|---|---|
| JP | 2002-226078 | 8/2002 |
| JP | 2002-258564 | 9/2002 |
| JP | 2007-128002 | 5/2007 |
| JP | 2008-151850 | 7/2008 |
| JP | 2008-209446 | 9/2008 |
| JP | 2010-25960 | 2/2010 |
| JP | 2010-164833 | 7/2010 |

* cited by examiner

IMAGE FORMING APPARATUS WITH A FAN FOR COOLING A CONVEYANCE PATH FOR TWO-SIDED IMAGE FORMATION

This application is based on Japanese Patent Application Serial No. 2011-031739 filed with Japan Patent Office on Feb. 17, 2011, the contents of which are hereby incorporated by reference.

BACKGROUND

The present disclosure relates to an image forming apparatus provided with conveyance paths for two-sided printing in which a recording sheet is conveyed in forming images on both sides of the recording sheet.

An image forming apparatus such as a copier or a printer includes an image forming unit for performing an image forming process to form an image on a recording sheet, a fixing unit for performing a fixing process to fix an image to a recording sheet by heat, a sheet conveyance path for conveying a recording sheet via the image forming unit and the fixing unit, and a conveyance path for two-sided printing, i.e. a so-called reversing conveyance path for conveying a recording sheet having the fixing process performed thereon to a side of the sheet conveyance path upstream of the image forming unit in the case of forming images on both sides of the recording sheet. The sheet conveyance path communicates with a discharge tray.

In the above image forming apparatus, a conveying unit which forms the sheet conveyance path and the reversing conveyance path and opens and closes the sheet conveyance path is supported by three slide guides so as to be slidable in a horizontal direction for the purpose of facilitating the processing of a jam which could occur in the sheet conveyance path. The first slide guide is provided in a lower end part of the conveying unit on a jam restoration processing access side (for example a front side of the image forming apparatus), and the second and third slide guides are provided in upper and lower end portions on a side opposite to the jam restoration processing access side in the conveying unit. Accordingly, an upper end portion of the jam restoration processing access side in the conveying unit is open. This enables a jam restoration processing to be easily performed from the open side.

In the above image forming apparatus, operability in jam restoration processing is improved by constructing the conveying unit as described above. However, image forming apparatuses of recent years are required to have improved operability in jam restoration processing and sufficiently cool a recording sheet being conveyed in a reversing conveyance path by a conveying unit. The recording sheet having an image fixed to one side thereof is hot. Thus, if an image is formed on the other side for two-sided printing without the recording sheet being cooled, the image is likely to be blurred by heat. If the image is blurred, a high-quality image cannot be formed.

Accordingly, in view of the above situation, an object of the present disclosure is to provide an image forming apparatus in which a jam restoration processing can be easily performed and high-quality images are formed on both sides by cooling a recording sheet.

SUMMARY

In order to achieve the above object, the present disclosure is directed to an image forming apparatus (1), comprising:

an apparatus main body (2);

an image forming station (92, 93, 94) arranged in the apparatus main body and adapted to perform an image forming process to form an image on a recording sheet;

a fixing unit (97) arranged in the apparatus main body and adapted to perform a fixing process to fix the image to the recording sheet by heat;

a first conveyance path (28) for conveying the recording sheet via the image forming station (92, 93, 94) and the fixing unit (97);

a second conveyance path (29) for conveying the recording sheet having the fixing process performed thereon to an upstream side of the image forming station in the case of performing the image forming process on both sides of the recording sheet;

a first cover (30) openably and closably attached to the apparatus main body; and a second cover (50) for covering the second conveyance path (29), the second cover (50) being openably and closably attached to the apparatus main body and openable and closable when the first cover (30) is in an open state and including a fan (523) for supplying an air stream to the second conveyance path (29).

In the image forming apparatus according to the present disclosure, the fan for supplying an air stream to the second conveyance path is provided on the second cover that covers the second conveyance path. The recording sheet passing in the second conveyance path is hot since the fixing process has been performed thereon, but cooled by the air stream by the fan. This suppresses blurring of a toner image by heat when the image forming process is performed on the remaining side of the recording sheet. As a result, a high-quality toner image can be ensured.

In addition, in the image forming apparatus according to the present disclosure, the second conveyance path is exposed to the outside by a simple operation of opening the first cover and the second cover covering the second conveyance path. Thus, a user can easily remove a recording sheet jammed in the second conveyance path.

DETAILED DESCRIPTION

Figure 1:
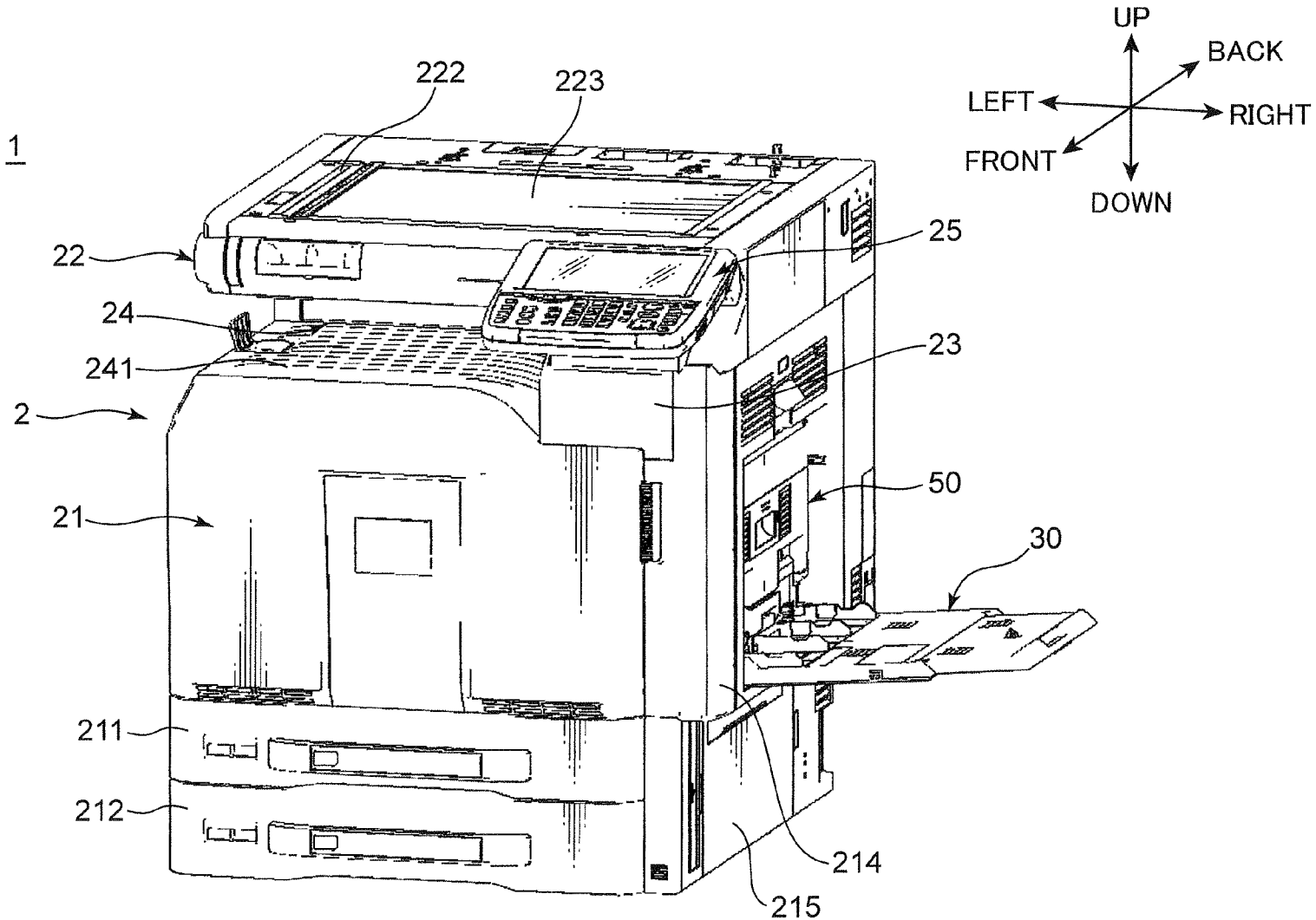
FIG. 1 is a perspective view showing the external appearance of an image forming apparatus according to one embodiment of the present disclosure.
Figure 2:
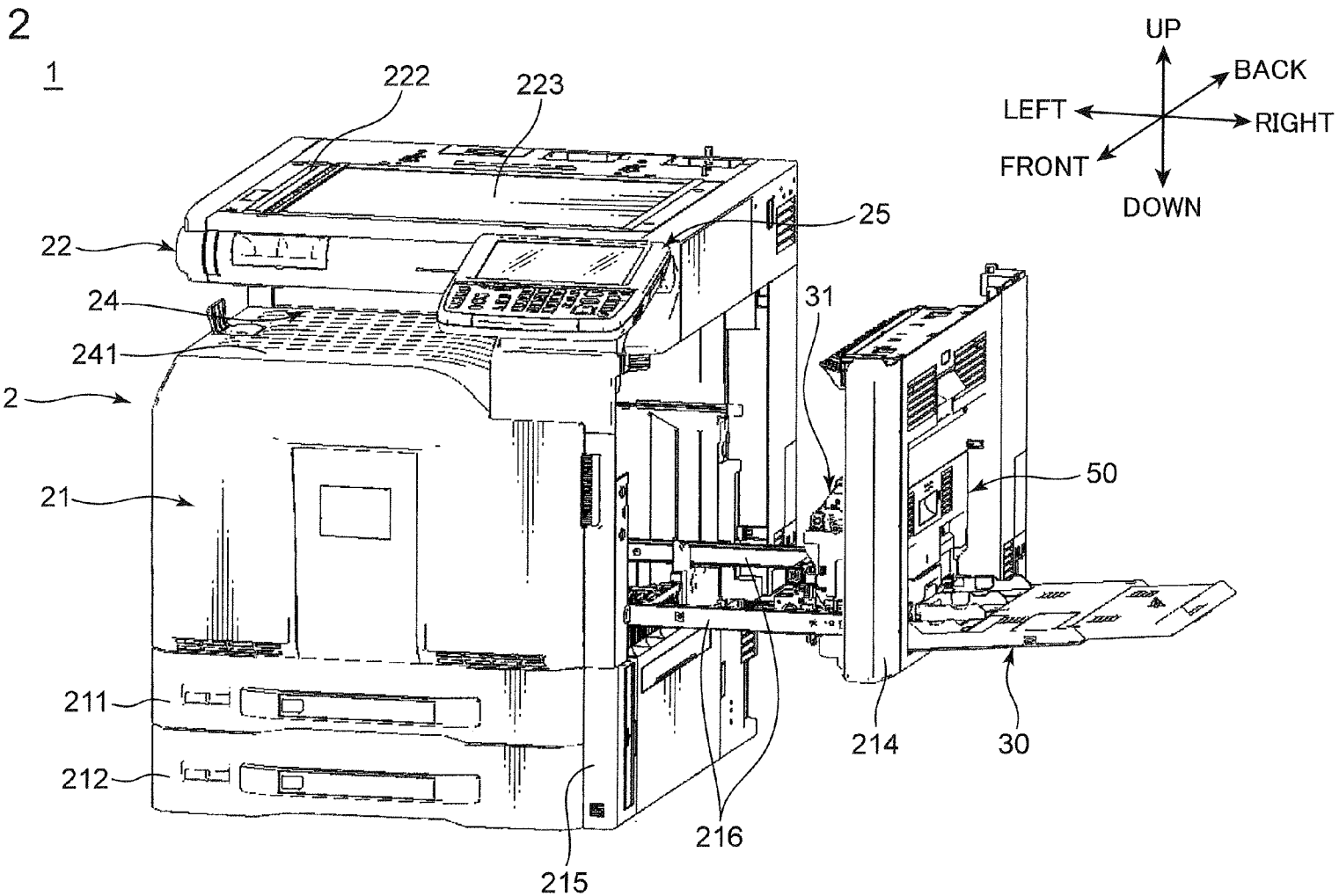
FIG. 2 is an external perspective view of the image forming apparatus showing a state where a movable part is slid.

Hereinafter, an embodiment of the present disclosure is described in detail based on the drawings. FIG. 1 is a perspective view showing the external appearance of an image forming apparatus 1 according to one embodiment of the present disclosure. FIG. 2 is an external perspective view of the image forming apparatus 1 showing a state where a movable part 214 is slid. Although a copier of an internal discharge type is illustrated as the image forming apparatus 1 here, the image forming apparatus 1 may be a printer, a facsimile machine or a MFP (Multi Function Peripheral) provided with these functions.

The image forming apparatus 1 includes an apparatus main body 2 having a substantially rectangular parallelepipedic housing structure and an internal space (internal discharge unit 24). The apparatus main body 2 includes a substantially rectangular parallelepipedic lower housing 21, a substantially rectangular parallelepipedic upper housing 22 arranged above the lower housing 21, and a coupling housing 23 coupling the lower housing 21 and the upper housing 22. Various devices for image formation are housed in the lower housing 21, and various devices for optically reading a document image are housed in the upper housing 22. The internal space enclosed by the lower housing 21, the upper housing and the coupling housing 23 serves as the internal discharge portion 24 capable of storing a sheet after image formation. The coupling housing 23 is arranged at a side of the right surface of the apparatus main body 2 and provided with a sheet discharge path 961 (FIG. 3) for discharging a sheet to the internal discharge unit 24.

The internal space utilized as the internal discharge portion 24 is exposed to the outside at the front surface and the left surface of the apparatus main body 2. A user can take out a sheet after image formation from the internal discharge portion 24 by inserting his hand through these exposed parts. A bottom surface 241 of the internal space is defined by the upper surface of the lower housing 21 and used as a discharge tray on which sheets discharged from the sheet discharge path 961 are to be stacked.

An operation panel unit 25 is provided to project from the front surface of the upper housing 22. The operation panel unit 25 is provided with operation keys including a numerical keypad and a start key, an LCD touch panel, etc. and receives input of various operation instructions from the user. The user can input the number of sheets to be printed, print density, etc. by means of the operation panel unit 25.

An unillustrated automatic document feeder (ADF) can be provided on the upper surface of the upper housing 22. The automatic document feeder automatically feeds a document sheet to be copied toward a predetermined document reading position (position where a first contact glass 222 is mounted) in the upper housing 22. On the other hand, when the user manually places a document sheet on a predetermined document reading position (arrangement position of a second contact glass 223), the automatic document feeder is opened upward.

Sheet cassettes 211, 212 for storing recording sheets on which an image forming process is to be performed are mounted in the lower housing 21. The sheet cassettes 211, 212 are cassettes provided for automatic sheet feeding and can store a large number of recording sheets according to sizes. The sheet cassettes 211, 212 can be withdrawn forward from the front surface of the lower housing 21.

The apparatus main body 2 includes a movable part 214 on the right surface. The movable part 214 forms the external appearance of an upper part of the right surface of the lower housing 21 and that of the right surface of the coupling housing 23. A lower side wall 215 below the movable part 214 forms a lower part of the right surface of the lower housing 21. Further, the movable part 214 and the lower side wall 215 form the right wall of the apparatus main body 2.

The movable part 214 is constructed to be slidable in a lateral direction and a horizontal direction relative to a frame (fixed part) forming the housing structure of the apparatus main body 2. The movable part 214 is slidably supported by a pair of guide rails 216 provided in the apparatus main body 2. When being pulled out to the right in a state shown in FIG. 1, the movable part 214 is slid to the right as shown in FIG. 2. By a sliding movement of the movable part 214, the internal space of the apparatus main body 2 appears and the movable part 214 is separated from the apparatus main body 2. This enables maintenance to be performed on an image forming unit 93, a fixing unit 97 and the like to be described later. Further, a reversing unit 31 and the like to be described later are provided on the back side of the movable part 214, i.e. a surface of the movable part 214 facing the internal space of the apparatus main body 2.

Further, a manual feed tray 30 used by the user for manual sheet feeding is attached to a surface of the movable part 214 facing outward. The manual feed tray 30 has a lower end portion thereof openably and closably attached to the movable part 214, and is closed when not in use. In the case of manual sheet feeding, the user opens the manual feed tray 30 and places a recording sheet thereon. FIGS. 1 and 2 show an open state of the manual feed tray 30.

Figure 3:
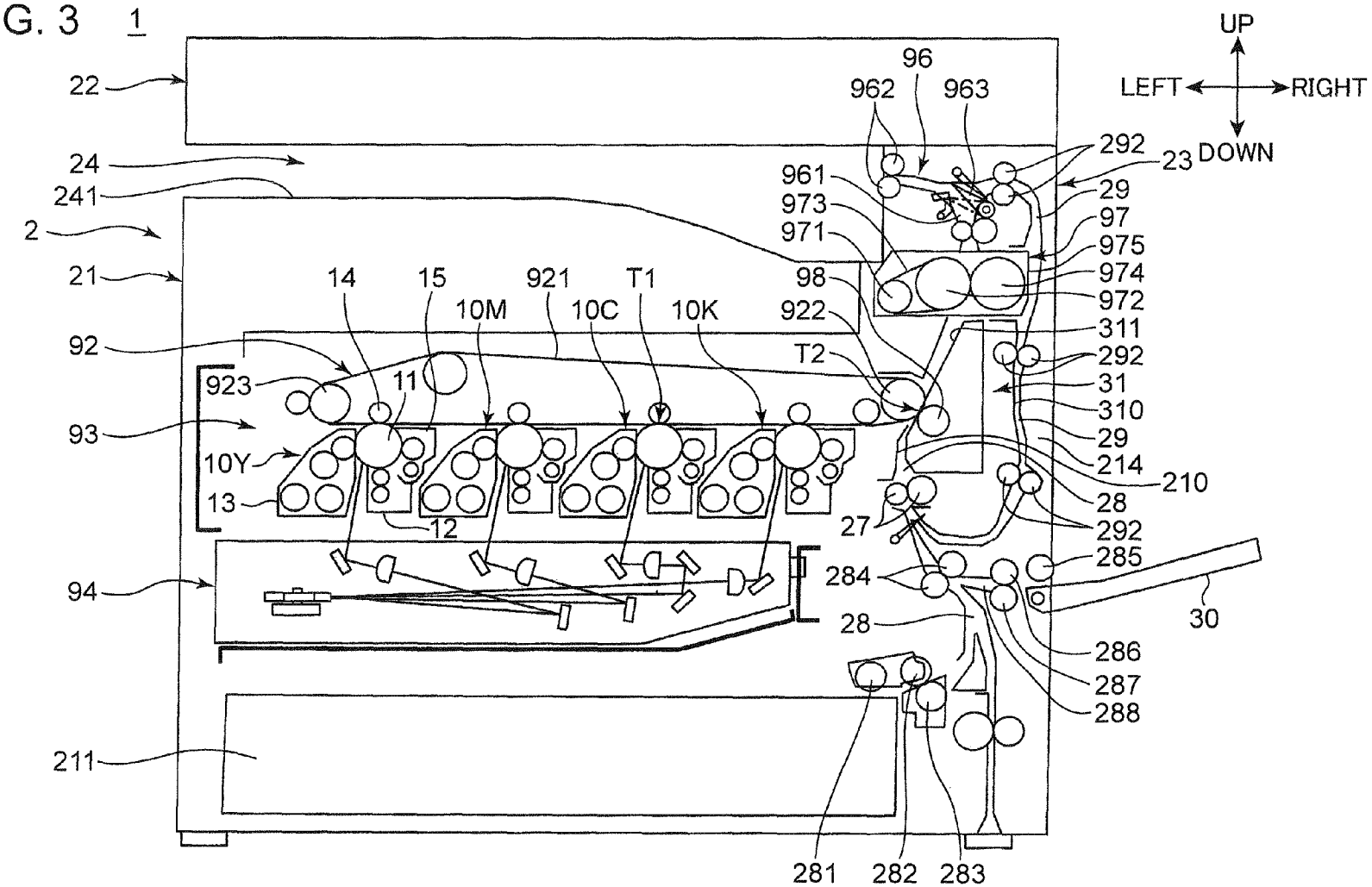
FIG. 3 is a sectional view showing the internal structure of the image forming apparatus.

FIG. 3 is a sectional view showing the internal structure of the image forming apparatus 1. The first contact glass 222 and the second contact glass 223 are mounted in the upper surface of the upper housing 22 (see FIG. 1). An unillustrated reading device is housed in the upper housing 22. The reading device optically reads document information of a document sheet fed to the first contact glass 222 by the automatic document feeder and document information of a document sheet placed on the second contact glass 223. The read image information is sent as image data to an exposure unit 94 to be described later.

An intermediate transfer unit 92, the image forming unit 93, the exposure unit 94, the sheet cassette 211 and the fixing unit 97 (fixing unit) are housed in the lower housing 21. Note that the sheet cassette 212 is not shown in FIG. 3. In this embodiment, the intermediate transfer unit 92, the image forming unit 93 and the exposure unit 94 constitute an image forming station for performing an image forming process to form a full color toner image (image) on a recording sheet.

The image forming unit 93 includes four image forming units 10Y, 10M, 10C and 10K for forming toner images of yellow (Y), magenta (M), cyan (C) and black (K). Each of the image forming units 10Y, 10M, 10C and 10K includes a photosensitive conductor drum 11, and a charger 12, a developing device 13, a primary transfer roller 14 and a cleaner 15 arranged around the photosensitive conductor drum 11.

The photosensitive conductor drum 11 rotates about its shaft and has an electrostatic latent image and a toner image formed on its circumference surface. The charger 12 uniformly charges the circumferential surface of the photosensitive conductor drum 11. The exposure unit 94 includes various optical devices such as a light source, a polygon mirror, a reflecting mirror and a deflecting mirror, and irradiates the circumferential surfaces of the photosensitive conductor drums 11 provided in the respective image forming units 10Y, 10M, 10C and 10K with beams based on image data of a document image of a document sheet to form electrostatic latent images.

The developing device 13 supplies toner to the circumferential surface of the photosensitive conductor drum 11 to develop an electrostatic latent image formed on the photosensitive conductor drum 11. In this way, a toner image is formed on the circumferential surface of the photosensitive conductor drum 11. Each developing device 13 receives the supply of the toner from an unillustrated toner container.

The primary transfer roller 14 forms a primary transfer nip portion T1 together with the photosensitive conductor drum 11 with an intermediate transfer belt 921 of the intermediate transfer unit 92 sandwiched therebetween, and primarily transfers the toner image on the photosensitive conductor drum 11 to the intermediate transfer belt 921. The cleaner 15 cleans the circumferential surface of the photosensitive conductor drum 11 after the transfer of the toner image.

The intermediate transfer unit 92 includes the intermediate transfer belt 921, a drive roller 922 and a driven roller 923. Toner images from a plurality of photosensitive conductor drums 11 are superimposed on the intermediate transfer belt 921 (primary transfer). The drive roller 922 is arranged to face a secondary transfer roller 98. The intermediate transfer belt 921 is sandwiched between the secondary transfer roller 98 and the drive roller 922, whereby a secondary transfer nip portion T2 is formed between the secondary transfer roller 98 and the intermediate transfer belt 921. The primarily transferred toner images are secondarily transferred to a recording sheet supplied from the sheet cassette 211 in the secondary transfer nip portion T2.

The sheet cassette 211 stores a sheet stack composed of a plurality of recording sheets stacked one over another. A pickup roller 281 is arranged above the right end of the sheet cassette 211. The pickup roller 281 picks up the uppermost recording sheet of the sheet stack in the sheet cassette 211. A pair of a feed roller 282 and a retard roller 283 are arranged downstream of the pickup roller 281 in a recording sheet pickup direction. The recording sheet is conveyed into a sheet conveyance path 28 by the feed roller 282. The retard roller 283 prevents the multiple feed of recording sheets.

The sheet conveyance path 28 extends from the feed roller 282 to the fixing unit 97 via the secondary transfer nip portion T2 (i.e. image forming unit 93). A pair of registration rollers 27 are arranged at a position of the sheet conveyance path upstream of the secondary nip portion T2. The pair of registration rollers 27 correct the skew of a recording sheet and feed the recording sheet to the secondary transfer nip portion T2 at a predetermined timing. A pair of conveyor rollers 284 are arranged between the feed roller 282 and the pair of registration rollers 27 in the sheet conveyance path 28.

On the other hand, a recording sheet placed on the manual feed tray 30 is conveyed to the sheet conveyance path 28 via a carry-in path 288 for manually fed sheets. A pickup roller 285 for picking up recording sheets on the manual feed tray 30 one by one is arranged at a position above the bottommost end of the manual feed tray 30. The carry-in path 288 joins the sheet conveyance path 28 right upstream of the pair of conveyor rollers 284. A pair of a feed roller 286 and a retard roller 287 are arranged in the carry-in path 288. The recording sheet is carried into the carry-in path 288 by the feed roller 286. The retard roller 287 prevent the multiple feed of the recording sheet.

The fixing unit 97 is for performing a fixing process to fix a secondarily transferred toner image to a recording sheet and includes a heating roller 971, a fixing roller 972, a fixing belt 973 mounted between the heating roller 971 and the fixing roller 972, and a pressure roller 974 arranged to face the fixing roller 972 with the fixing belt 973 therebetween. The recording sheet having the toner image secondarily transferred thereto is heated and pressed when passing through a fixing nip portion between the fixing belt 973 and the pressure roller 974. In this way, the toner image is fixed to the recording sheet. The heating roller 971, the fixing roller 972 and the pressure roller 974 are respectively rotatably housed in a housing 975.

A sheet discharge unit 96 is provided in the coupling housing 23. The discharge unit 96 includes a sheet discharge path 961 extending from the fixing unit 97 toward the discharge tray 241 and a pair of discharge rollers 962 arranged in the sheet discharge path 961. The recording sheet having the fixing process performed thereon passes in the sheet discharge path 961 and is discharged onto the discharge tray 241 by the pair of discharge rollers 962. In this embodiment, the sheet conveyance path 28 and the sheet discharge path 961 form a first conveyance path of the present disclosure.

Figure 4:
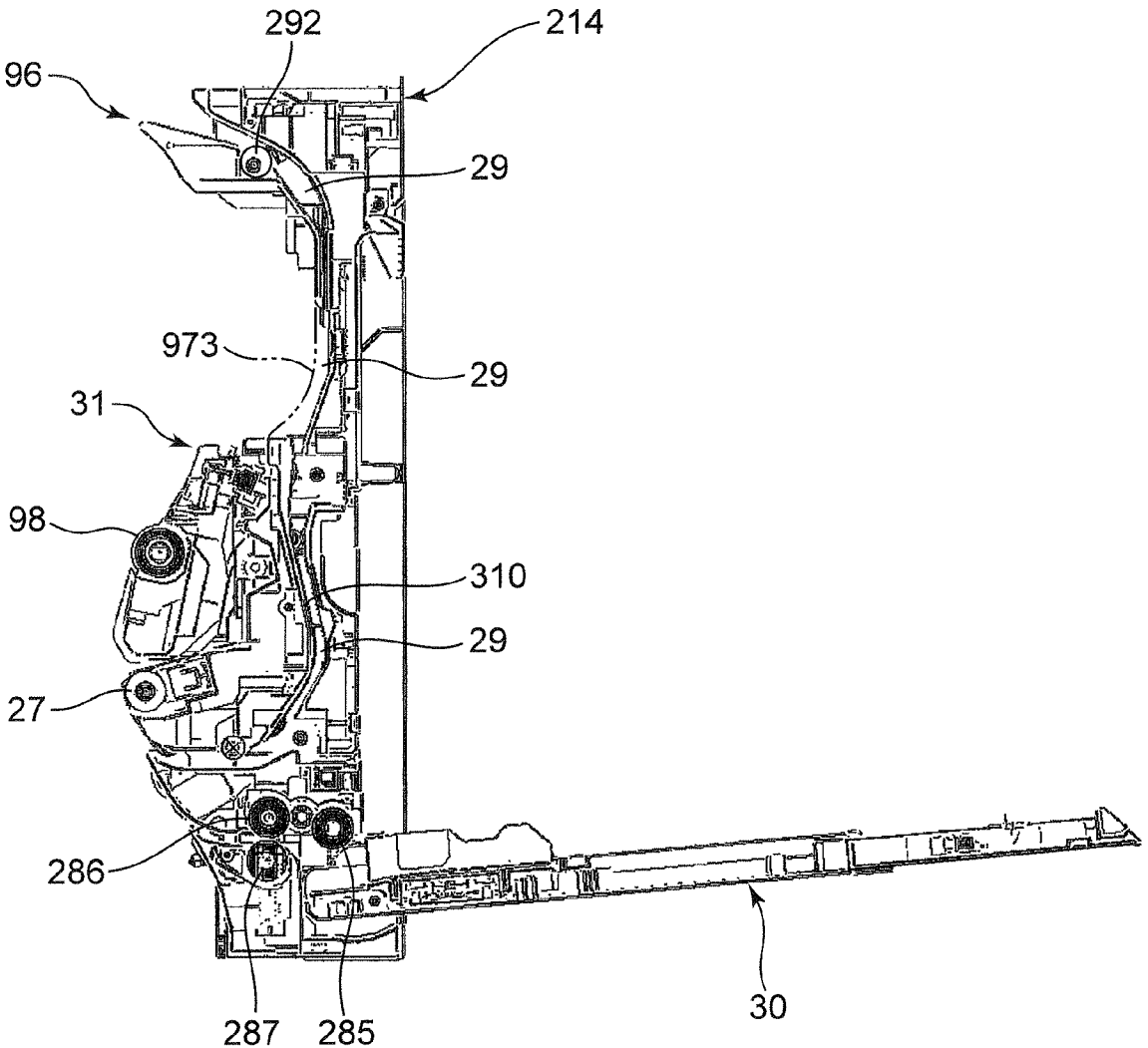
FIG. 4 is an enlarged sectional view showing the construction of a reversing conveyance path and its periphery.

In addition to the sheet conveyance path 28 and the sheet discharge path 961, a reversing conveyance path 29 is provided in the apparatus main body 2. The reversing conveyance path 29 is described with reference to FIGS. 3 and 4. FIG. 4 is an enlarged sectional view showing the construction of the reversing conveyance path 29 and its periphery. The reversing conveyance path 29 is a conveyance path which forms a second conveyance path of the present invention and in which a recording sheet is passed in the case of performing the image forming process on both sides of the recording sheet. The reversing conveyance path 29 is branched off from the sheet discharge path 961, vertically extends from the coupling housing 23 toward the lower housing 21, and joins the sheet conveyance path 28 right upstream of the pair of registration rollers 27.

An upper part of the reversing conveyance path 29 is composed of a conveyance path part on the right upper side (FIG. 4) communicating with the sheet discharge unit 96, a part formed between the right wall surface of the housing 975 of the fixing unit 97 (FIG. 3) and the left surface of the movable part 214 (FIG. 4) and a part extending along a right surface 310 of the reversing unit 31 (FIG. 4). Three pairs of conveyor rollers 292 are arranged one above another in the reversing conveyance path 29. The uppermost pair of conveyor rollers 292 are arranged between the back side of the movable part 214 and the sheet discharge unit 96. The lower two pairs of conveyor rollers 292 are arranged between the back side of the movable part 214 and the right surface 310 of the reversing unit 31.

A switching claw 963 is arranged at a branch point between the sheet discharge path 961 and the reversing conveyance path 29. The switching claw 963 switches the conveyance path for a recording sheet between the sheet discharge path 961 and the reversing conveyance path 29 by rotating. When an image forming process is performed on both sides of the recording sheet, the switching claw 963 rotates from a position shown by solid line in FIG. 3 to a dotted-line position to close the sheet discharge path 961 and open the reversing conveyance path 29 when the trailing end of the recording sheet passes the switching claw 963. Further, the pair of discharge rollers 962 temporarily stop when the trailing end of the recording sheet passes the switching claw 963, and then rotate in reverse directions. In this way, the recording sheet passing in the sheet discharge path 961 is guided to the reversing conveyance path 29 with the trailing end in the lead.

In the case of performing the image forming process on both sides of a recording sheet, the recording sheet is guided to the reversing conveyance path 29 by the pair of discharge rollers 962 and the switching claw 963 after a toner image secondarily transferred to one side is fixed by the fixing unit 97. The recording sheet guided into the reversing conveyance path 29 is conveyed to a joint position with the sheet conveyance path 28 by the pairs of conveyor rollers 292 arranged in the reversing conveyance path 29. The recording sheet having reached the joint position is conveyed to the secondary transfer nip portion T2 at a predetermining timing by the pair of registration rollers 27. A toner image is secondarily transferred to the other side of the recording sheet in the secondary transfer nip portion T2. Then, the recording sheet is conveyed to the fixing unit 97 and the toner image secondarily transferred to the other side is fixed. At this time, the switching claw 963 is controlled to close the reversing conveyance path 29 and open the sheet discharge path 961 by an unillustrated controller. The recording sheet having the toner images formed on the both sides as described above is discharged onto the discharge tray 241 via the sheet discharge path 961.

Note that a part of the sheet conveyance path 28 is defined between a left surface 311 opposite to the right surface 310 in the reversing unit 31 and a predetermined inner wall 210 (see FIG. 3) formed in the lower housing 21. Further, a part of the sheet discharge path 961, the reversing unit 31, a set of rollers 285, 286 and 287 for conveying a manually fed recording sheet, one registration roller 27, the secondary transfer roller 98 and one conveyor roller 284 are supported on the back side of the movable part 214. Accordingly, when the movable part 214 is pulled out as shown in FIG. 2, these members are exposed to the outside, i.e. the sheet conveyance path 28 and the sheet discharge path 961 are exposed to the outside.

Figure 5:
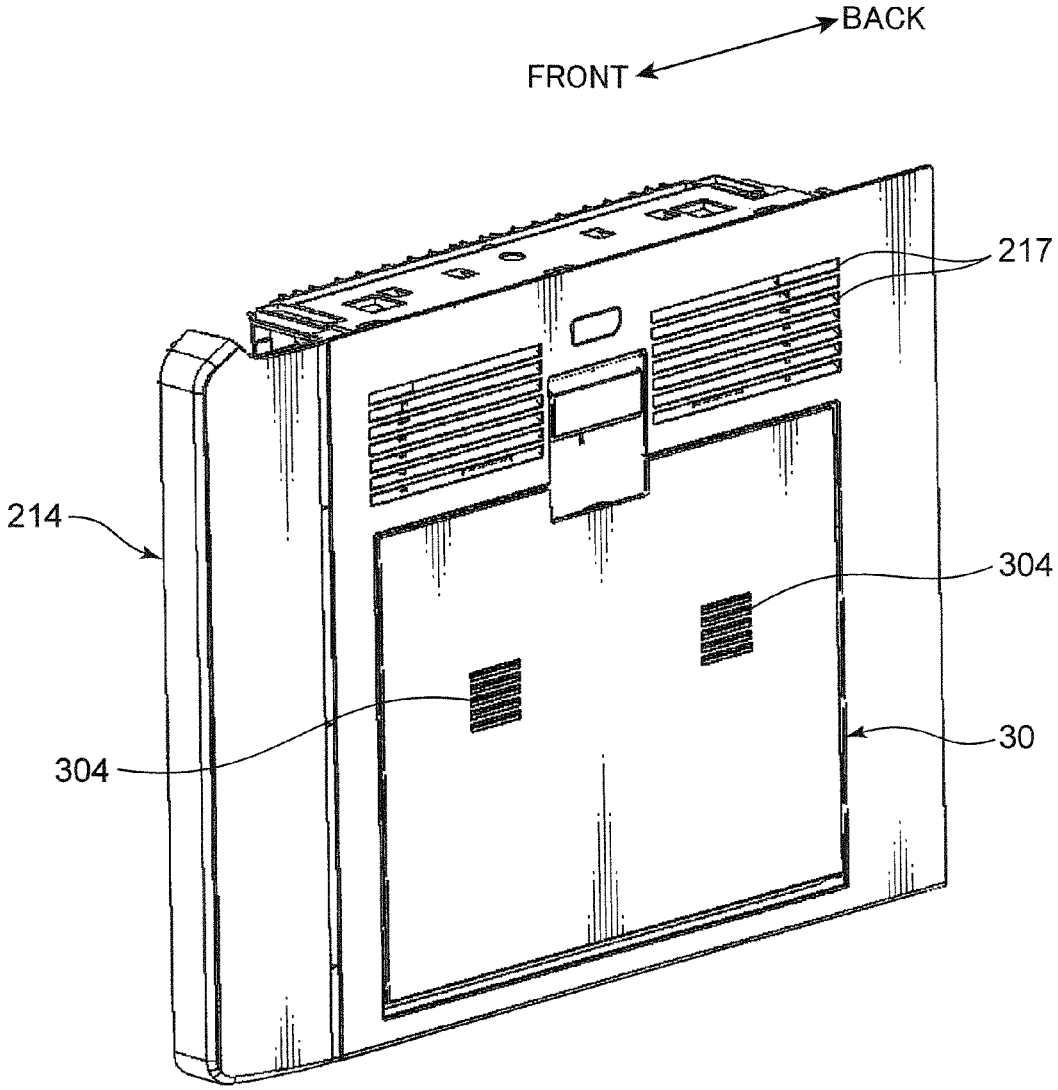
FIG. 5 is a perspective view of the movable part.
Figure 6:
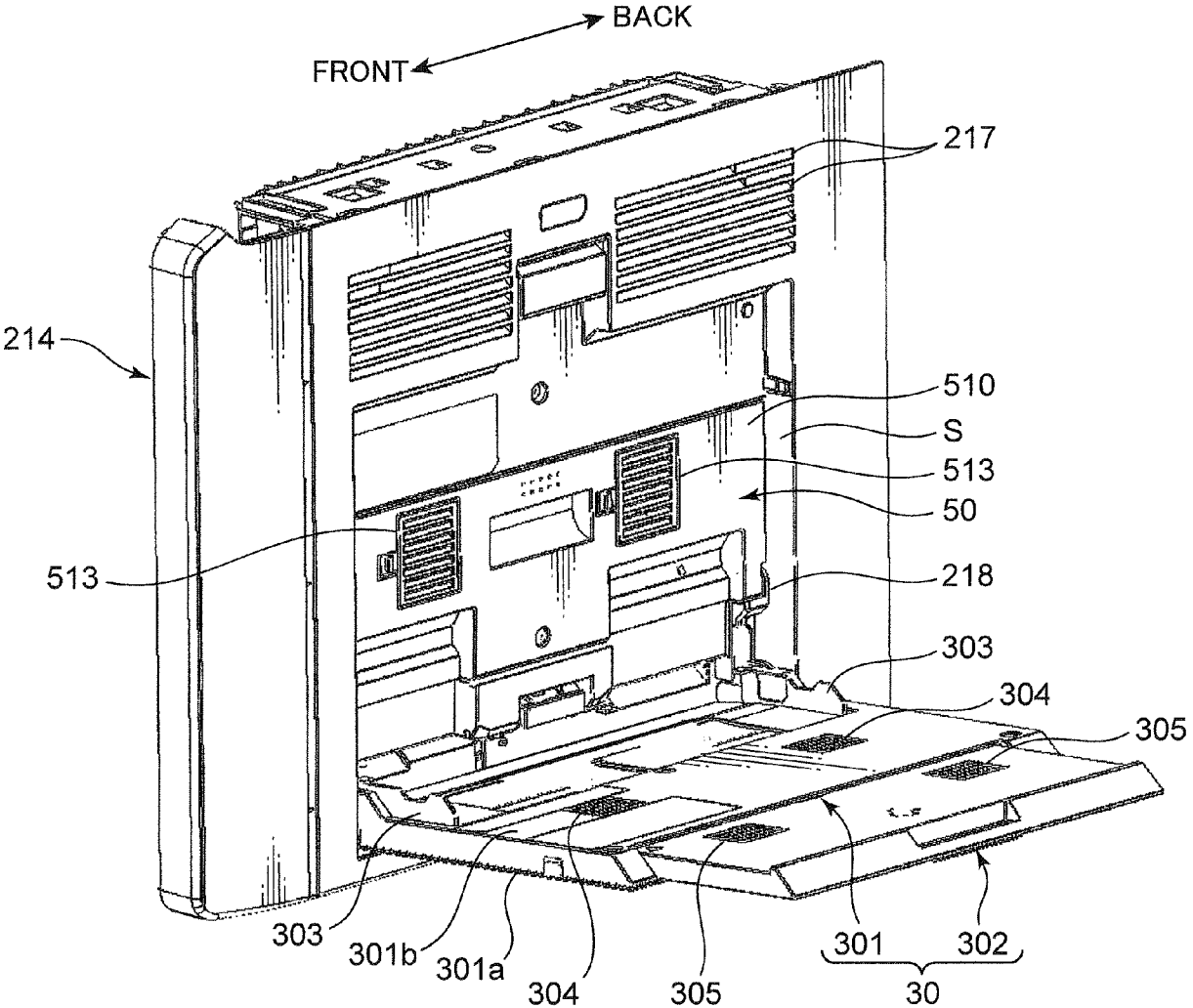
FIG. 6 is a perspective view of the movable part in a state where a manual feed tray is open.

Next, the construction of the movable part 214 is described in detail with reference to FIGS. 5 and 6. FIG. 5 is a perspective view of the movable part 214. FIG. 6 is a perspective view of the movable part 214 in the open state of the manual feed tray 30. Above the manual feed tray 30, the movable part 214 includes louvers 217 for taking the outside air into the apparatus main body 2. Further, as shown in FIG. 6, a recess S for housing the manual feed tray 30 is formed in the outer surface of the movable part 214. The shape of the recess S conforms to the outer contour shape of the manual feed tray 30.

The manual feed tray 30 has a two-level configuration including a tray main body 30 and a tray extension portion 302. The tray main body 301 has a first tray surface 301*a* facing outward and a second tray surface 301*b* located on a side opposite to the first tray surface 301*a* and facing toward the apparatus main body 2 in a closed state. A recording sheet is to be placed on the second tray surface 301*b* by the user. A longitudinal direction (forward and backward directions of the apparatus main body 2 in FIG. 6) of the tray main body 301 is a width direction of a recording sheet to be placed on the second tray surface 301*b*. A pair of cursors 303 for aligning the recording sheet in the width direction are arranged on the second tray surface 301*b*.

The tray extension portion 302 is mounted to be insertable into and withdrawable from a space between the first and second tray surfaces 301*a* and 301*b*. By pulling out the tray extension portion 302, a recording sheet can be stably placed on the manual feed tray 30. The recording sheet placed on the second tray surface 301*b* is carried into the carry-in path 288 from the second tray surface 301*b* in a direction (i.e. lateral direction of the apparatus main body 2) perpendicular to the width direction of the recording sheet by the set of rollers 285, 286 and 287 (see FIG. 3). In this embodiment, the manual feed tray 30 constitutes a first cover of the present disclosure.

In addition to the manual feed tray 30, a cover 50 for jam restoration processing (hereinafter, referred to as a second cover) is attached to the movable part 214. The second cover 50 is opened and closed when a recording sheet is jammed in the reversing conveyance path 29. The second cover 50 has a lower end portion thereof rotatably supported on the movable part 214 and can be opened and closed only when the manual feed tray 30 is open. With the manual feed tray 30 closed, the second cover 50 is arranged to face the second tray surface 301*b* of the tray main body 301 and extend in parallel with the second tray surface 301*b*. Thus, the second cover 50 forms a bottom part of the recess S where the manual feed tray 30 is housed.

Figure 7:
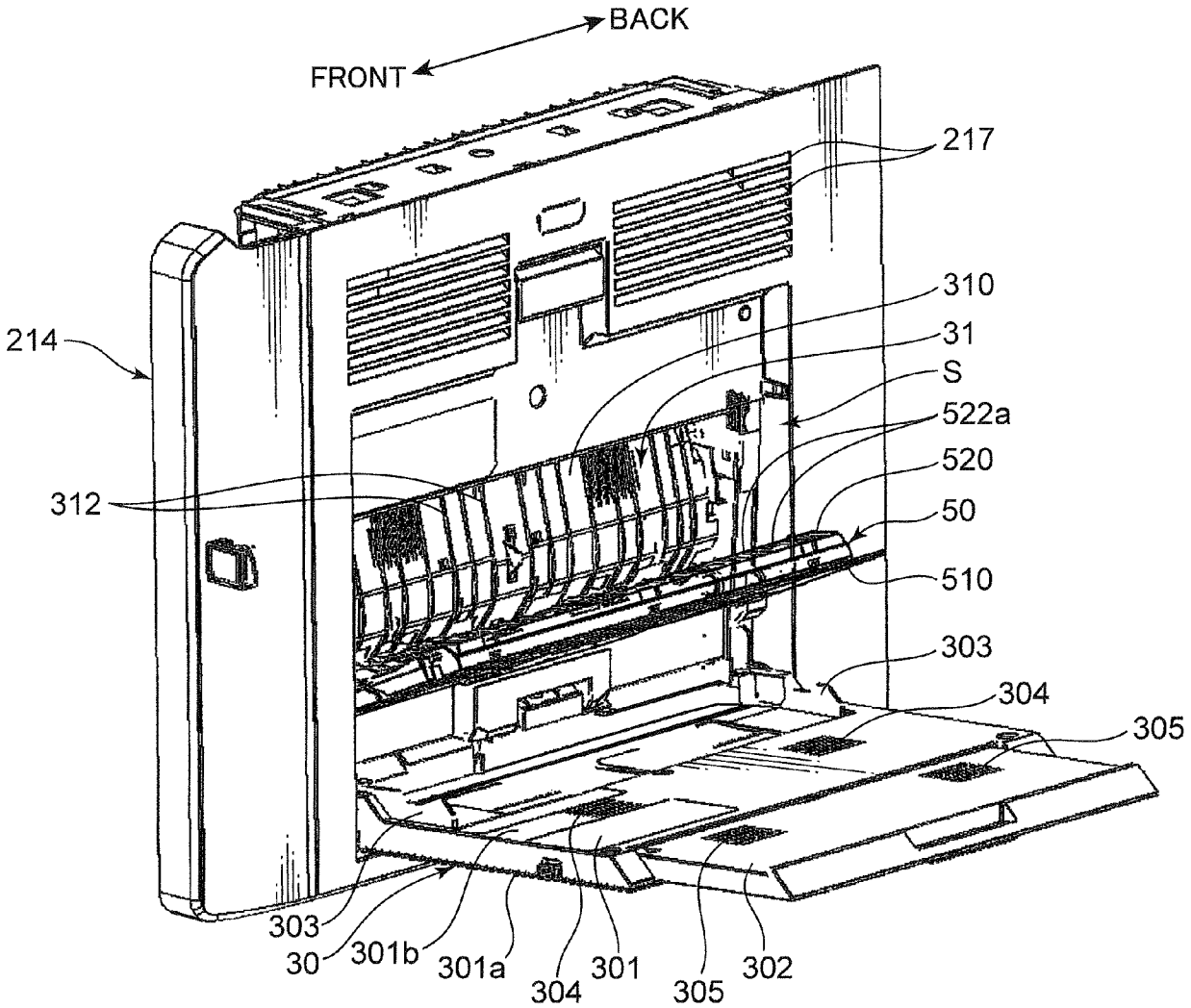
FIG. 7 is a perspective view showing an open state of a second cover.

In a closed state, one surface of the second cover 50 is facing the second tray surface 301*b* of the manual feed tray 30 and the other surface thereof is facing the right surface 310 of the reversing unit 31. Accordingly, the second cover 50 covers a part of the reversing conveyance path 29 and constitutes a conveyance path part of the reversing conveyance path 29 together with the right surface 310 of the reversing unit 31. If a recording sheet is jammed in the part of the reversing conveyance path 29 between the right surface 310 of the reversing unit 31 and the second cover 50, the manual feed tray 30 is first opened and then the second cover 50 is opened. In this way, the above conveyance path part of the reversing conveyance path 29 is exposed to the outside as shown in FIG. 7. The user inserts his hand into the exposed reversing conveyance path 29 and removes the jammed recording sheet. A longitudinal direction of the second cover 50 is the width direction of the recording sheet passing in the reversing conveyance path 29, and a dimension of the second cover 50 in the longitudinal direction is set to be substantially equal to or larger than the width of the recording sheet. Thus, the user can easily remove the jammed recording sheet from the reversing conveyance path 29. Note that the right surface 310 of the reversing unit 31 is formed with guide ribs 312 for smoothly conveying the recording sheet.

Figure 8:
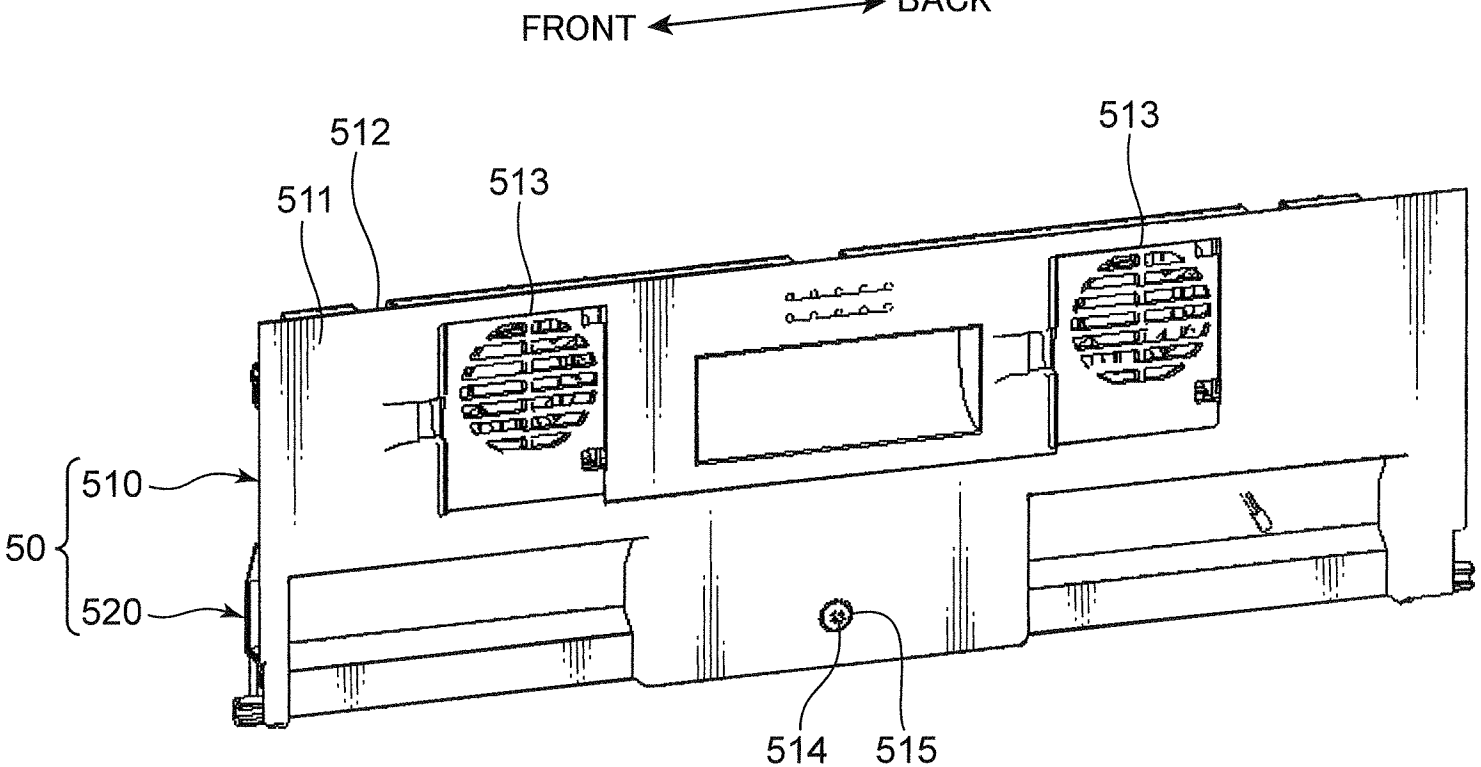
FIG. 8 is a perspective view of the second cover when viewed from a first half body.

Next, the structure of the second cover 50 is described with reference to FIGS. 8 and 9. The second cover 50 is composed of a first half body 510 and a second half body 520. FIG. 8 is a perspective view showing the second cover 50 when viewed from the first half body 510.

Figure 9:
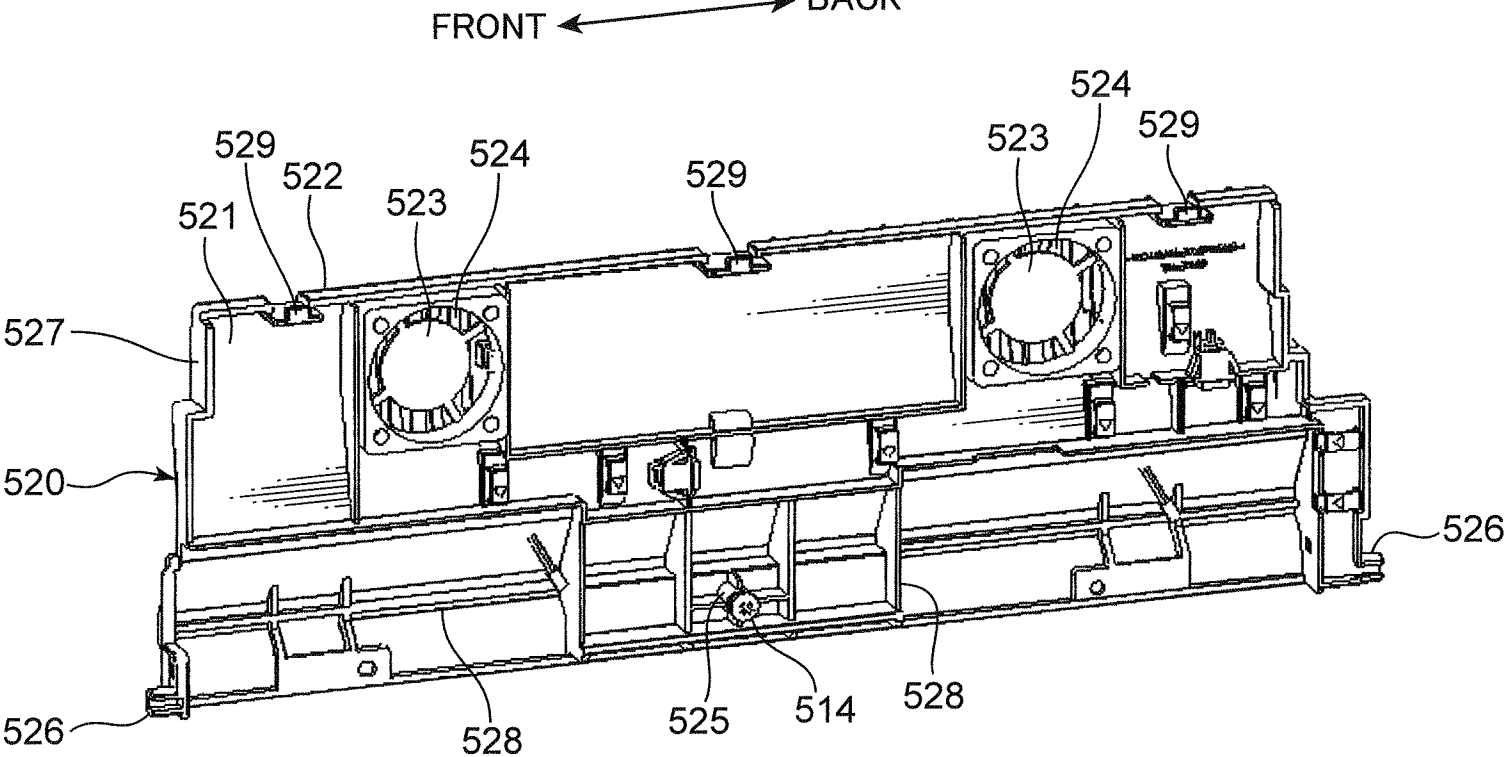
FIG. 9 is a perspective view of a second half body of the second cover.

FIG. 9 is a perspective view of the second half body 520 with the first half body 510 removed from the second cover 50. The first half body 510 is a part facing the manual feed tray 30 and the second half body 520 is a part facing the right surface 310 of the reversing unit 31.

The first half body 510 is a flat plate-like member and formed with a pair of openings penetrating from an outer surface 511 to an inner surface 512 at the opposite sides of a longitudinal central part (at the front and rear sides of the longitudinal central part in FIG. 8). A first louver portion 513 composed of a plurality of louvers is provided at each opening. Note that although the shape of the louvers shown in FIG. 8 and that of the louvers shown in FIG. 6 differ, the shape of the louvers is not particularly limited.

Further, a screw hole 515 into which a fastening member, e.g. a screw 514 is to be inserted, is formed in a part of the first half body 510 near the lower edge of the longitudinal central part.

The second half body 520 includes a first surface 521 facing the first half body 510, a second surface 522 located on a side opposite to the first surface 521 and facing the right surface 310 of the reversing unit 31, a wall portion 527 extending from the outer peripheral edge of the second half body 520 toward the first half body 510 (i.e. toward the first surface 521), and a plurality of reinforcing ribs 528 for structurally reinforcing the second half body 520.

On the first surface 521, a pair of fans 523 are provided at the opposite sides of a longitudinal central part of the second half body 520 (at the front and rear sides of the longitudinal central part in FIG. 9). The fans 523 are rotated by supplying power from an unillustrated drive source. The second half body 520 is formed with a pair of openings penetrating from the first surface 521 to the second surface 522 at positions corresponding to the pair of fans 523, and second louver portions 524 each composed of a plurality of louvers are provided at the respective openings. The second louver portions 524 are provided on the second surface 522. Further, the positions of the first louver portions 513 of the first half body 510 are set to correspond to the fans 523 and the second louver portions 524.

The manual feed tray 30 includes tray side louver portions (vents) at positions facing the first louver portions 513, the second louver portions 524 and the fans 523 of the second cover 50 in the closed state. Specifically, the tray main body 301 includes a pair of first tray side louver portions 304 and the tray extension portion 302 includes a pair of second tray side louver portions 305. The first louver portions 513, the second louver portions 524, the fans 523, the first tray side louver portions 304 and the second tray side louver portions 305 are set to be located on the same lines.

The fans 513 supply air streams to the reversing conveyance path 29 via the second louver portions 524 by taking in the outside air through the first tray side louver portions 304, the second tray side louver portions 305 and the first louver portions 513 by rotation. In this way, a recording sheet passing in the reversing conveyance path 29 is cooled.

Shaft portions 526 projecting in opposite directions are formed at the respective opposite longitudinal end portions of the second half body 520. The movable part 214 is formed with bearing portions 218 (see FIG. 6) for rotatably supporting the shaft portions 526. In this way, the second cover 50 is made openable and closable.

A screw hole 525 into which the screw 514 is to be fastened is formed in a part of the second half body 520 near the lower edge of the longitudinal central part. Further, three locking pieces 529 are formed at predetermined intervals in the longitudinal direction on the upper edge of the second half body 520. The first half body 510 is formed with unillustrated locking portions to be engaged with the locking pieces 529 of the second half body 520.

Accordingly, the first and second half bodies 510, 520 are assembled with each other by engaging the locking portions of the first half body 510 with the locking pieces 529 of the second half body 520 to put the first and second half bodies 510, 520 together and screwing the screw 514 into the screw hole 525 of the second half body 520 through the screw hole 515 of the first half body 510.

As shown in FIG. 7, a plurality of guide ribs 522*a* for smoothly conveying a recording sheet are formed on the second surface 522.

In the image forming apparatus 1 according to the embodiment described above, the second cover 50 that covers the part of the reversing conveyance path 29 is provided with the fans 523 for supplying air streams to the reversing conveyance path 29. A recording sheet passing in the reversing conveyance path 29 is hot since the image forming process has been performed thereon, but cooled by the air streams by the fans 523. This suppresses blurring of a toner image by heat when the image forming process is performed on the remaining side of the recording sheet. As a result, a high-quality toner image can be ensured.

In addition, in the image forming apparatus 1 according to this embodiment, the reversing conveyance path 29 is exposed to the outside by a simple operation of opening the manual feed tray 30 and the second cover 50. Thus, the user can easily remove a recording sheet jammed in the reversing conveyance path 29. The manual feed tray 30 is a member originally provided in the image forming apparatus 1 and easily opened and closed.

Accordingly, even in the case of adopting a construction for opening the manual feed tray 30 for a jam restoration processing, no cumbersome sense is given to the user. Further, by providing the manual feed tray 30 and the second cover 50 on the same side surface (i.e. the second cover 50 can be opened and closed only when the manual feed tray 30 is open), the external configuration of the apparatus main body 2 and a degree of freedom in designing the internal construction of the apparatus main body 2 can be better ensured as compared with the case where the manual feed tray 30 and the second cover 50 are mounted on different side surfaces of the apparatus main body 2.

Further, in the image forming apparatus 1 according to this embodiment, the manual feed tray 30 includes the first tray side louver portions 304 and the second tray side louver portions 305 at the positions facing the fans 523 provided on the second cover 50. Since the fans 523 can efficiently take in the outside air in this way, an improvement in cooling effect can be expected.

Furthermore, since the movable part 214 mounted with the manual feed tray 30 and the second cover 50 is constructed to be slidable in the image forming apparatus 1 according to this embodiment, the internal space of the apparatus main body 2 appears when the movable part 214 is slid as shown in FIG. 2. This enables maintenance to be performed on the image forming unit 93, the fixing unit 97 and the like. Further, since the sheet conveyance path 28 and the sheet discharge path 961 are exposed to the outside by sliding the movable part 214, a recording sheet jammed in the sheet conveyance path 28 and the sheet discharge path 961 can be removed. This further facilitates a jam restoration processing.

Although the present disclosure has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an apparatus main body, the apparatus main body being a substantially rectangular parallelepipedic housing;

an image forming station arranged in the apparatus main body to perform an image forming process to form an image on a recording sheet;

a fixing unit arranged in the apparatus main body to perform a fixing process to fix the image to the recording sheet by heat;

a first conveyance path for conveying the recording sheet via the image forming station and the fixing unit;

a second conveyance path for conveying the recording sheet having the fixing process performed thereon to an upstream side of the image forming station in the case of performing the image forming process on both sides of the recording sheet;

a first cover openably and closably attached to the apparatus main body, the first cover being a manual feed tray on which a recording sheet to be conveyed to the first conveyance path is to be placed and the first cover being openably and closably attached to the housing; and a second cover for covering the second conveyance path, the second cover being openably and closably attached to the apparatus main body and openable and closable when the first cover is in an open state and the second cover including a fan for supplying an air stream to the second conveyance path.

2. An image forming apparatus according to claim 1, wherein:

the first cover includes a vent at a position facing the fan.

3. An image forming apparatus according to claim 2, wherein:

a vent through which air can flow in a thickness direction of the second cover is formed at a position of the second cover facing the fan, and the vent and the fan of the second cover and the vent of the first cover are located on the same line when the first cover and the second cover are both in a closed state.

4. An image forming apparatus, comprising:

an apparatus main body, the apparatus main body including a fixed part and a movable part horizontally movable relative to the fixed part;

an image forming station arranged in the apparatus main body to perform an image forming process to form an image on a recording sheet;

a fixing unit arranged in the apparatus main body to perform a fixing process to fix the image to the recording sheet by heat;

a first conveyance path for conveying the recording sheet via the image forming station and the fixing unit;

a second conveyance path for conveying the recording sheet having the fixing process performed thereon to an upstream side of the image forming station in the case of performing the image forming process on both sides of the recording sheet, a part of the first conveyance path and the second conveyance path being provided in the movable part, and the first cover and the second cover being attached to the movable part;

a first cover openably and closably attached to the apparatus main body; and a second cover for covering the second conveyance path, the second cover being openably and closably attached to the apparatus main body and openable and closable when the first cover is in an open state and including a fan for supplying an air stream to the second conveyance path.

5. An image forming apparatus according to claim 4, wherein:

the apparatus main body is a substantially rectangular parallelepipedic housing; and the first cover is a manual feed tray on which a recording sheet to be conveyed to the first conveyance path is to be placed and which is openably and closably attached to the housing.

6. An image forming apparatus according to claim 4, wherein:

a recess capable of housing the first cover is formed in the outer surface of the movable part and a part of a bottom part of the recess is formed by the second cover when the first cover is in the open state.

7. An image forming apparatus according to claim 6, wherein:

the outer surface of the second cover forming the bottom part of the recess is exposed when the first cover is opened and the second cover is openable and closable in that state.

8. An image forming apparatus according to claim 7, wherein:

the first cover is openable and closable using a lower end portion thereof as a pivot point and the second cover is openable and closable using a lower end portion thereof as a pivot point in the open state of the first cover.

9. An image forming apparatus according to claim 4, wherein:

the first conveyance path is opened by horizontally moving the movable part from the fixed part, and the second conveyance path is made accessible by opening the first cover and the second cover.

* * * * *